US005237763A

United States Patent [19]

Ochoa

[11] Patent Number: 5,237,763

[45] Date of Patent: Aug. 24, 1993

[54] SILHOUETTE TRADING CARD HOLDER

[76] Inventor: Richard Ochoa, 3562 Helen Dr., Pleasanton, Calif. 94588

[21] Appl. No.: 787,565

[22] Filed: Nov. 4, 1991

[51] Int. Cl.[5] ..... A47G 1/06

[52] U.S. Cl. ..... 40/152.1; 206/45.19

[58] Field of Search ..... 40/152.1, 124.4, 124.1, 40/538, 1, 358, 120; 206/45.14, 45.28, 45.15, 486–490, 45.18, 45.19, 45.2, 45.23, 44 B

[56] References Cited

U.S. PATENT DOCUMENTS

| | | | |
|---|---|---|---|
| 1,104,253 | 4/1914 | Dunphee | 206/45.2 |
| 1,586,666 | 6/1926 | Folts | 206/45.18 |
| 2,149,978 | 3/1939 | Noel | 40/120 |
| 2,297,574 | 9/1942 | McCord | 40/152.1 |
| 2,361,840 | 10/1944 | Hauton et al. | 206/45.14 |
| 2,787,067 | 4/1957 | Nichols | 40/152.1 |
| 3,836,007 | 9/1974 | Rosenwein | 206/45.15 X |
| 3,879,874 | 4/1975 | Broussard . | |
| 4,033,060 | 7/1977 | Lawrence | 40/152.1 |
| 4,467,540 | 8/1984 | Gfesser, Jr. | 40/152.1 |
| 4,905,828 | 3/1990 | Dods | 206/45.19 X |
| 4,944,968 | 7/1990 | Wagner . | |
| 4,979,619 | 12/1990 | Hager . | |
| 4,993,560 | 2/1991 | Jaffe . | |

FOREIGN PATENT DOCUMENTS

| | | | |
|---|---|---|---|
| 8101232 | 11/1979 | PCT Int'l Appl. | 206/45.28 |
| 463373 | 11/1968 | Switzerland | 206/45.28 |

OTHER PUBLICATIONS

Krause Publication, "Sports Collectors Digest" Oct. 25, 1991, p. 10, Hobby News Briefs.

*Primary Examiner*—Laurie K. Cranmer

[57] ABSTRACT

A trading card holder consisting of two components, a silhouette member (10) and a base container (26), use to display and store trading cards or the like. Both components are made from a strong brightly colored smooth material such as plastic. The manner of display consists of a display opening (18), somewhat centrally located, on a formed silhouette member (10), bearing the likeness of an individual, corresponding to the displayed trading card's field of participation. The three dimensional silhouette member (10) surrounded by outlining walls (12) create a back cavity (14) use to support a wall mount. The bottom outlining wall (13) rest the silhouette member (10) on a platform (30) of the base container (26). The dog block (35) on the platform (30) surface in conjunction with the horizontal fence (32) stabilizes the silhouette member (10). The platform (30) extends from a storage box (28) use to housed additional trading cards (23). The construction of the storage box (28) permits a plurality of stored trading cards (23) to stand in an upright manner. By leaning the upright trading cards in either a forward and backward motion or an up and down motion one can preview, insert and retrieve the trading cards with ease.

9 Claims, 3 Drawing Sheets

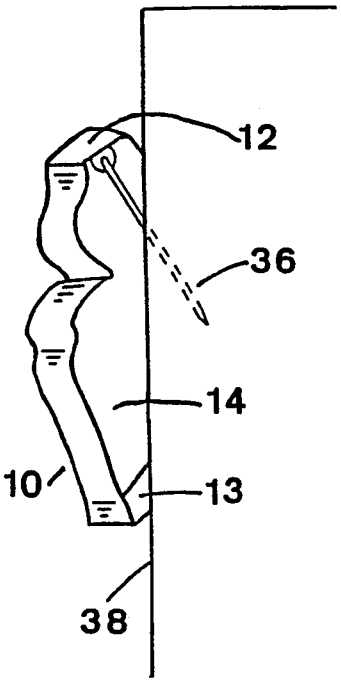
FIG. 4
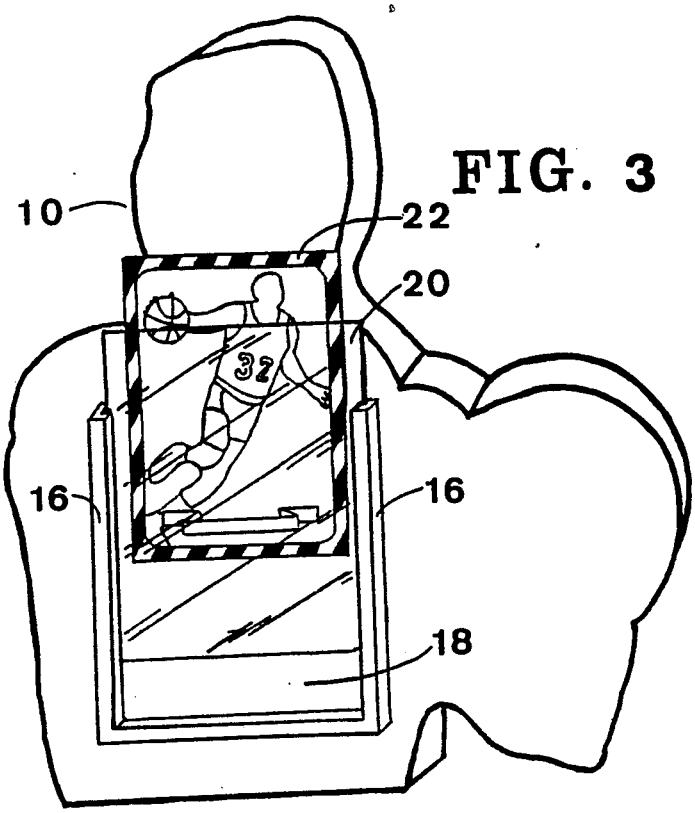
FIG. 3
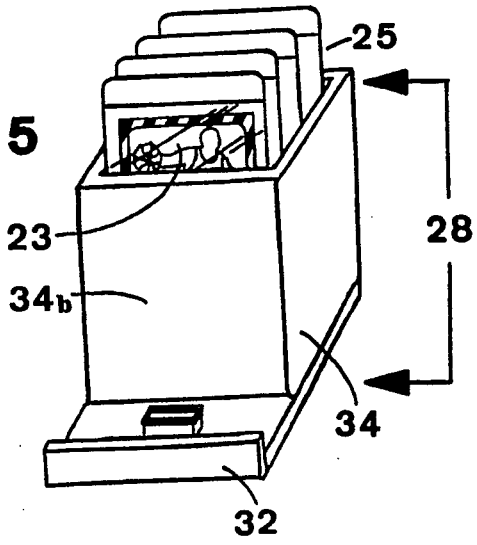
FIG. 5
FIG. 2
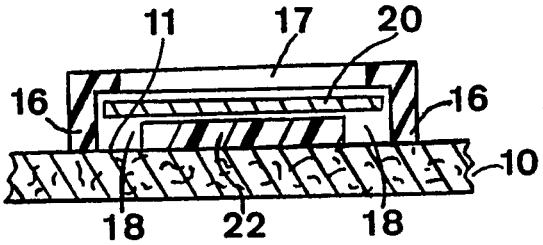

SILHOUETTE TRADING CARD HOLDER

BACKGROUND—FIELD OF INVENTION

This invention relates to card holders in particular trading card holders that identify, display, store, and protect.

BACKGROUND—DESCRIPTION OF PRIOR ART

Many trading card collectors prefer to identify, display, store, and protect their collection in as pristine condition as possible. The common trading card holder generally provides one or two of these functions with emphasis on storing and protecting. Heretofore a wide variety of trading card holders have been implemented.

Common trading card holders display trading cards in an open fashion. Typically behind some type of window, or inserted in a transparent sleeve or case for clear viewing. In order to identify the trading card one needs to get a close look. Yet sometimes a close look doesn't always help. A lot of trading cards feature an individual from the shoulders up. This is especially true of older cards. If the individual is not wearing or holding some type of identifying equipment it becomes more difficult to identify what field that person participates in. Sometimes the name of the person may not help either. Unless you recognize the person or their name you may not be able to identify the type of trading card even at close range.

Identifying a trading card from a distance, such as across the room, can be more difficult. The small size of the card and the lack of additional visual aid contribute to this problem. Naturally you have the window or transparent sleeve or case to help but typically that's it. The lack of creatively in the configuration of common holders, like picture frames, wall plaques and single trading card holders, does little to identify the type of trading card. Their configurations are generally plane geometric shapes such as rectangles, ovals, and squares.

Common holders like picture frames, wall plaques and single card holders provide limited display mount capabilities. For the most part wall plaques and picture frames are for wall mounts, while single card holders just lay flat on a horizontal surface.

Common storage trading card holders consist of clear plastic boxes, cardboard boxes, and loose leaf binders. The clear plastic boxes store the trading cards face down one on top of another. Being the unit is clear only the top or bottom card can be seen. In order to locate a card not lying on the top surface, one has to dump all the cards and search through the pile. This dumping action can jeopardize the condition of the cards.

The cardboard box stores the cards sideway. When the box is full, one tends to grab a number of cards in a trial an error effort before a desired card is found. This constant handling of the cards can jeopardize their condition. The jeopardy factor increases when the box is not full. In this condition there is an absence of barrier on one end of the stack. This absence causes the cards to be dislodged when the box is moved. This dislodging action disturbs a numerically organize stack as well as jeopardizes the cards.

The loose leaf binder stores the cards but when displaying them the binder needs to be open. Most people do not leave them in an open position but rather store them on a shelf, on a desk or in a closet. When this occurs you've comprised the binder's display features.

Common protective trading card holders consist of a screw down type, a snap together type, and a protective sleeve type. Each use the same concept of sandwiching a card between two sheets of clear plastic. It is of primary concern the two sheets do not separate easily. With the screw down type there are four screws in each corner. This holder does not disassemble without the aid of a separate tool. This makes it mandatory to find and use a screwdriver and unscrew all four corners.

The snap type uses tension to keep the two sheets together. To separate the sheets it is essential to apply the correct amount of pressure in the proper position. Being the holder is clear and the areas not defined it is difficult to perceive where to press and by how much. Many times you press with no successful results.

The protective sleeve is not made to separate the two sheets but rather to form a pocket. This pocket is made of a thin plastic material which prevents the trading card from being soiling or scratch. Unfortunately due to the thin materials use and the lack of a rigid back the trading card is susceptible to bending.

The disadvantages of all of the trading card holders listed are their limit range of use. They do not effectively incorporate all of the features of identifying, displaying, storing and protecting in one system. In particular they do not appreciate nor do they recognize the effective use of a trading card holder's configuration as a form of art and a visual aid to identity.

OBJECTS AND ADVANTAGES

Accordingly several objects and advantages of my invention are:

(a) to provide a system for organizing trading cards greater than the sum of its parts:

(b) to provide a trading card holder which uses brightly colored materials to stimulate interest:

(c) to provide a trading card holder which helps identify the type of trading card being displayed, from any reasonable distance by:

1. providing a silhouette member in an artistic form as the primary display holder;
2. providing the silhouette member which bears the likeness of an individual or individuals in a displayed trading card's field of participation;
3. providing the silhouette member with action poses that captures an exciting moment of the displayed trading card's field of participation;

(d) to provide a trading card holder which offers more display mount capabilities by:

1. providing a centrally located display opening on the silhouette member for ease of viewing;
2. providing a plurality of support components to attach the silhouette member to a vertical wall with ease of use;
3. providing a base container for the silhouette member to attach in an upright freestanding manner with ease of use;
4. providing a simple method of previewing the stored trading cards;

(e) to provide a trading card holder which stores additional trading cards in a separate container:

(f) to provide a trading card holder which protects its contents by:

1. providing supports in the display opening which stabilize the trading card;

2. providing space in the display opening for a trading card in a protective sleeve;
3. providing space in a storage box for trading cards in protective sleeves;
4. providing a storage box with surrounding walls to encase the trading cards;
5. providing an additional barrier to the stored trading cards by use of the silhouette member.

Further objects and advantages are to provide minimum effort in previewing, inserting, and removing all trading cards, which minimize potential damage, and incorporate the simplicity of design and materials in manufacturing an inexpensive product. Still further objects and advantages will become apparent from a consideration of the ensuing description and drawings.

DRAWINGS FIGURES

For a further understanding of the invention as well as other features and objects thereof, reference should be made to the following description, taken in conjunction with the accompanying drawing wherein:

FIG. 2 is a sectional top view of a display opening framed in by narrow guide strips.

FIG. 3 is a plan view of the silhouette member with a trading card, and a window sheet.

FIG. 4 is a side rear view of the silhouette member supported on a vertical wall.

FIG. 5 is a plan view of a storage box with housed trading cards in semi-rigid card holders.

DESCRIPTION

Figure 1:
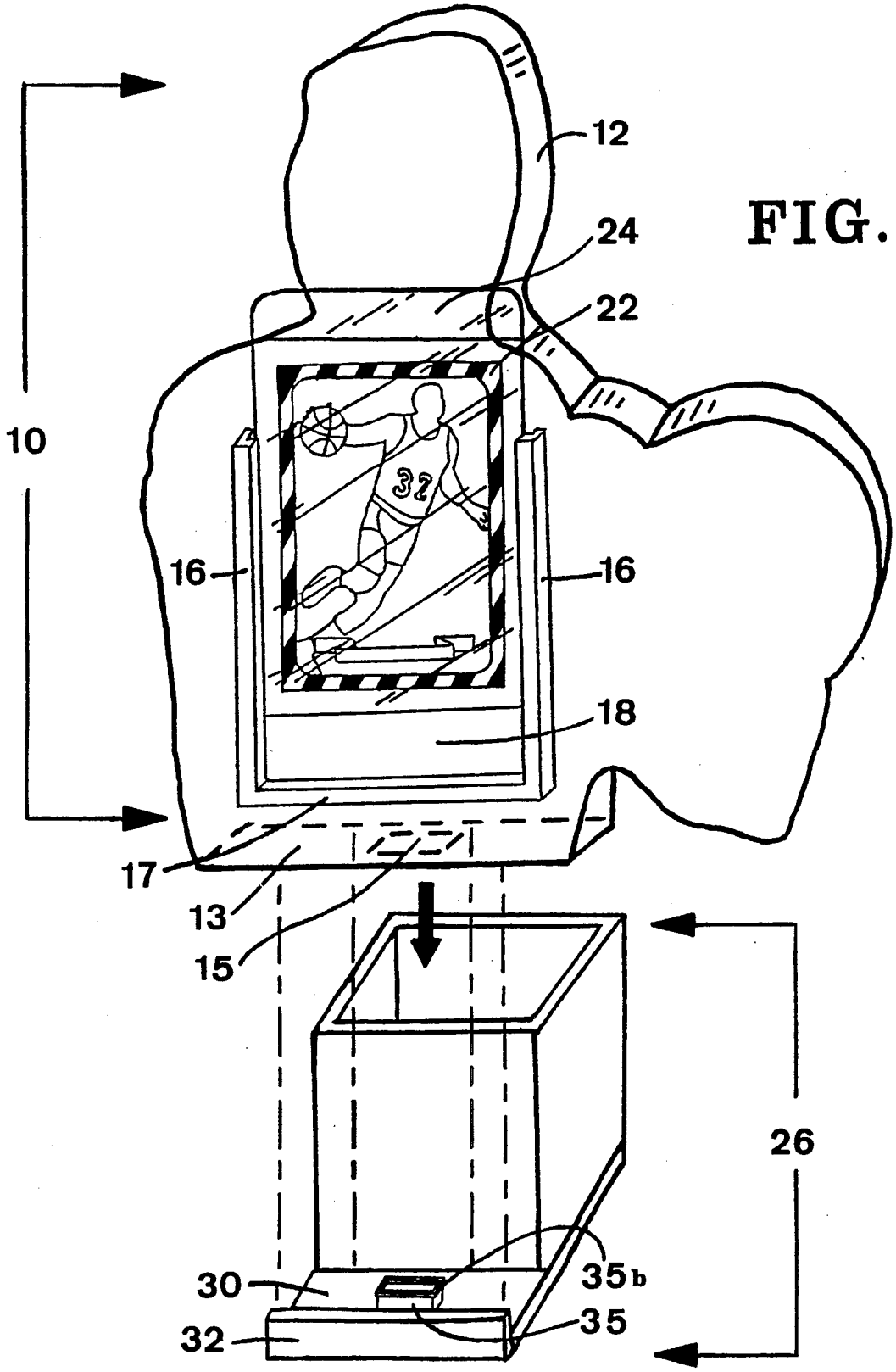
FIG. 1 is a plan view of a silhouette member with base container.
Figure 6:
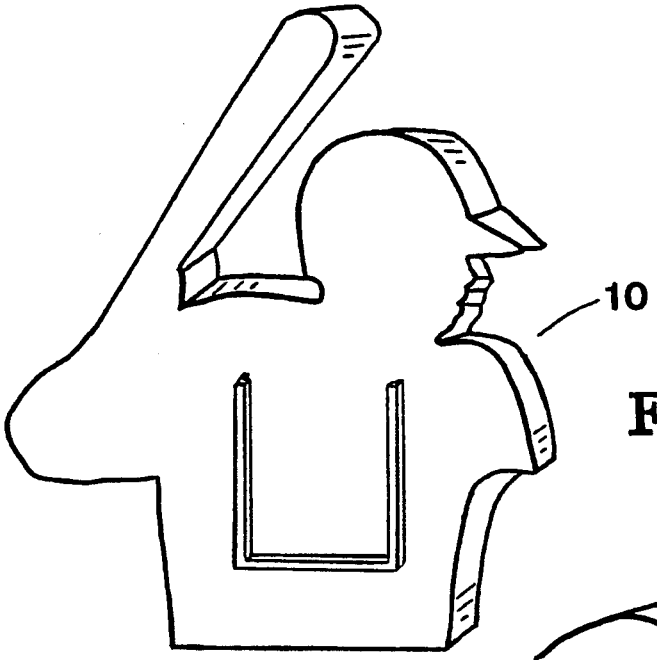
FIG. 6 is a plan view of a silhouette member.
Figure 7:
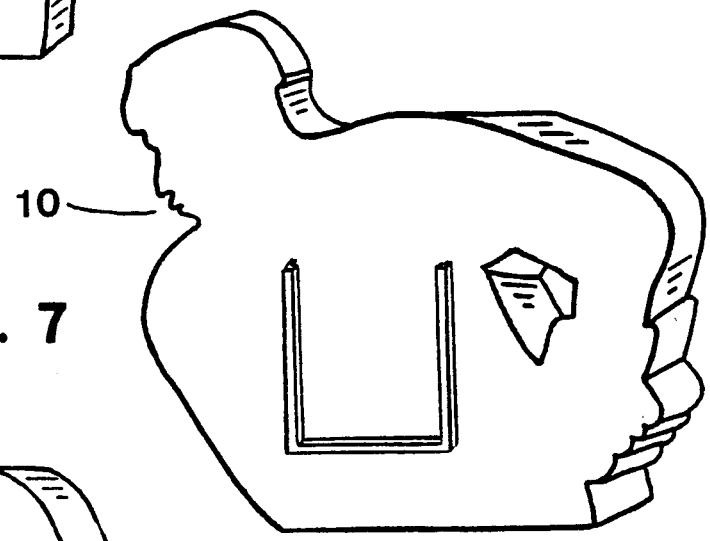
FIG. 7 is a plan view of a silhouette member.
Figure 8:
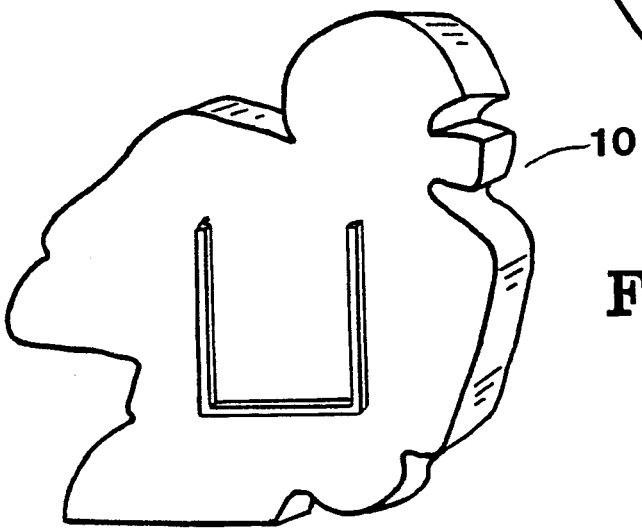
FIG. 8 is a plan view of a silhouette member.

A typical embodiment of a trading card holder of the present invention is illustrated in FIG. 1. With reference to FIG. 1, FIG. 6, FIG. 7, and FIG. 8 a primary display holder is molded from a strong, smooth, brightly colored, finished material such as plastic, into a three dimensional silhouette member 10. Surrounding the molded silhouette member are outlining walls 12. These outlining walls form a cavity 14 behind silhouette member 10 as shown in FIG. 4. Positioned on the surface of a bottom outlining wall 13 is a cutout opening 15 centrally located as shown in FIG. 1.

On the front surface of silhouette member 10, somewhat centrally located, are three narrow guide strips, two side strips 16 and a bottom strip 17. From a top end view the strips are rabbeted to form an upside down L shape as shown in FIG. 2. Strips 16 and 17 are line up to form a square bottom U shape display opening 18 as shown in FIG. 1. In a contained area of the display opening a back stop 11 is formed by the front surface of silhouette member 10 in FIG. 2. The display opening is sized slightly in excess of the dimensions of a window sheet 20 and a trading card 22 in a semi-rigid card holder 24. Semi-rigid card holder is a generic term for a clear vinyl pocket 9 millimeters thick, 3 inches wide, 4 inches high, with an extended ½ inch lip, use to house a single trading card.

A base container 26 is formed from a strong, smooth, brightly colored, finished material such as plastic. The base container comprises of a rectangular storage box 28 with an extended platform 30 adjacent to a horizontal fence 32. The dimensions of a plurality of storage box walls 34 allow a plurality of trading cards 23 in a plurality of semi-rigid card holders 25 to stand in an upright manner as shown in FIG. 5. The bottom of the storage box extents in a parallel manner beyond a front wall **34*b* to form platform 30. On the surface of platform 30 centrally located is a dog block 35, as shown in FIG. 1, with a bead 35*b* circumventing the top portion. The front portion of the platform butts up to fence 32**. The fence extends above the platform in a perpendicular manner.

OPERATION AND FUNCTION

In order to identity any type of trading card, one needs to use a distinguishable corresponding figure for the silhouette member. A distinguishable figure is formed by the silhouette member bearing the likeness of an individual in the trading card's field of participation as shown in FIG. 1, FIG. 6, FIG. 7, and FIG. 8. To further aid in identity and also artistic expression, an exciting moment in the trading cards field of participation is captured in the silhouette member figure. As an example shown in FIG. 2, when wanting to identity a basketball trading card in display opening 18, a basketball players' figure, getting ready to pass a ball, is used for silhouette member 10. By using brightly colored materials for the silhouette trading card holder additional artistic appeal is achieved.

When showcasing trading card 22 in display opening 18 a protective sleeve or cover is needed to hold trading card 22 in place. Both semi-rigid card holder 24 or window sheet 20 provide this function. In displaying trading card 22 slide it along with holder 24 or sheet 20, down the silhouette member's surface into display opening 18. Both edges of holder 24 or sheet 20 will be guided down by the rabbeted edges of side strips 16, as shown in FIG. 1 and FIG. 3. The trading card, with holder 24 or sheet 20, will come to rest on bottom strip 17. To remove the trading card, with its protective sleeve or cover, slide all of the material up and out. When sliding trading card 22 and holder 24 or sheet 20 press them against back stop 11 for leverage.

To wall mount the silhouette member, as shown in FIG. 4, suspend it on a nail like projection 36 extending from a vertical wall 38. To accomplish this, position the back side of the silhouette member over the nail like projection. With the nail going into the back cavity slide the silhouette member down the face of the vertical wall. Keep sliding till the top portion of the nail's head rests on the back side of the outlining wall. The back side of the outlining walls supports the silhouette member on the nail head and against the wall.

To display the silhouette member in an upright free-standing manner utilize base container 26. Begin by holding the front surface of silhouette member 10 toward you and directly over platform 30. Next line up cutout opening 15, on the bottom outlining wall of silhouette member 10, directly over dog block 35. Dog block 35 is located on platform 30. Now lower the silhouette member straight down over the dog block till cutout opening snaps over bead **35*b*. Once snapping is performed the bottom outlining wall comes to rest on the platform's surface. Fence 32 prevents the silhouette member from sliding off platform 30. Both the fence with the dog block stabilize silhouette member 10 on the base container. Base container 26 supports the silhouette member on any flat surface. Base container 26 also stabilizes silhouette member 10 when inserting and removing the trading cards in display opening 18**.

In order to store additional trading cards the base container's storage box is used. Storage box 28 allows trading cards 23 to lean either forward or backward in an upright position. It also allow trading cards 23 to slide in an up and down motion. The storage box further provides additional room to all trading cards to be housed in holders 25 and when not in use sheet 20. To insert a trading card position the card in an upright manner directly over storage box 28. Move the trading card straight down till the bottom of the card touches the bottom of the storage box. When the storage box contains additional trading cards hold the top portion of these cards and lean them forward. This movement creates an opening for the new trading card. To preview the trading cards hold the top portion again and simply lean the cards forward or backward. To remove the cards pinch the top portion of the trading cards and slide it straight up and out.

To protect the trading cards from being soiled, scratch, or bent, protective sleeves or covers and firm supports are needed. In display opening 18 both side strips 16 with bottom strip 17 provide firm support. They securely hold trading card 22, with holder 24 or sheet 20, in place. Back stop 11 provides rigid support for trading card 22 back surface. Both holder 24 and sheet 20 provides a protective barrier to trading card 22 front surface. By providing additional room for single snap type card holders, or small plastic storage boxes, and semi-rigid card holders, storage box 28 facilitated more protection. The strong materials used for storage box walls 34 provide a protective barrier to its content. When silhouette member 10 is housed in base container 26 it also provides an additional protective barrier to trading cards 23 in storage box 28.

CONCLUSION, RAMIFICATIONS AND SCOPE OF INVENTION

The silhouette member helps to identity the type of trading card by using a corresponding figure in the trading card's field. Not only does it identity the trading card but does so in an artistic fashion. An element of art is capturing the essence of a subject matter in a pleasing arrangement. The silhouette member accomplish this in its use of distinguishable figures in interesting action poses. The action poses captures the essence of the trading card's field of participation. The pleasing arrangement is the overall shape of the silhouette trading card holder and its functional use of existing parts. Besides the use of shape and function, bright colored materials used, such as plastics, add to its inherent beauty and interest.

To display the trading card on the silhouette member simply slide the card, with a protective cover, down the display opening. To remove it just slide the trading card up and out. To display the trading card on the wall just suspend the backside of the silhouette member on any nail like projection. To display the trading card on any flat surface simply snap the silhouette member over the dog block onto the base container's platform.

The storage box is constructed to provide room for additional trading cards in an upright manner. This positioning makes previewing the trading cards as simple as leaning them forward or backward. To insert a new card just lean the store trading cards forward and slide in the new card. To remove the trading cards simply pull the card up and out.

In addition the storage box accommodate single snap type card holders, small plastic storage boxes and semi-rigid card holders. These extra card holders provide additional protection to the stored trading cards. The construction of the storage box walls provides a protective barrier surrounding its contents. Also by positioning the silhouette member in front of the storage box another protective barrier is used. The construction and materials of the silhouette member, the display opening, and the base container provide rigid support to all of the trading cards being displayed or stored.

Thus the reader will see the silhouette trading card holder is an organize system for trading cards greater than its components. Because the silhouette members are stimulating and a form of artistic expression, the collector's interest will carry far beyond the physical components of the present invention. Not only does it provide identity, display, storage, and protection, it does so in an ethically pleasing arrangement of shape, function, and color. Working in conjunction with all its components, the silhouette member and the base container complement the utmost effectiveness of space and materials. It does so in an economically inexpensive trading card holder which provides durability and pleasure to any collector or non collector alike.

While my above description contains many specificities, these should not be construed as limitations on the scope of the invention, but rather as an exemplification of one preferred embodiment thereof. Many other variations are possible. For example by using two or more silhouette figures as one silhouette member and duplicating the display opening, two or more trading cards can be displayed. With the use of two figures one can capture an exciting moment in the field of participation. An example would be a silhouette baseball pitcher in his pitching stance with a silhouette batter ready to hit.

Another variation to the silhouette member is providing a more three dimensional appearance. By highlighting such details as clothing, equipment, and facial features this new appearance can be achieved. Additional appearance changes can also be made to the storage box. The storage box can take the appearance of equipment used in the trading card's field of participation. An example would be a storage box shape in the form of a baseball, basketball, or football.

Though the examples used are sport related it does not confine that limitation to the present invention. Specifically all non-sport trading cards such as music, cartoons, comic, movies, television, military, and so forth are also complementary subject matters.

Further structural changes can be used to provide additional functions. By forming a small box or pocket, in the back cavity of the silhouette member, additional trading cards can be stored.

By attaching a hook, or tab to the top portion, or horizontal plate to the back portion of the silhouette member, a wall mount can be performed. The tab or hook would suspend the silhouette member on a protruding nail from a vertical wall. The horizontal plate with a nail hole opening would perform the same function as well.

By providing snap in attachments a more stable horizontal surface mount can be achieved. One snap in attachments can take the form of raised horizontal lines snapping into grooves. The lines could be positioned on the silhouette member while the grooves could be positioned on the fence and the storage box.

By using the platform additional display area can be provided. Simply lean the trading card upright on the platform surface. The storage box will provide the back support while the fence will provide the front support. To further highlight the trading card enlarge the storage box front wall.

To provide additional protection a lid for the storage box can be used. By placing a lid over the top portions of the trading cards all of the cards in the storage box can be encased.

Though the silhouette trading card holder is designed for trading cards, a further variation can accommodate other paper collectibles. By enlarging the entire silhouette trading card holder larger items such as comic books, magazines and photographs can also be used. Accordingly, the scope of the invention should be determined not by the embodiments illustrated, but by the appended claims and their legal equivalents.

I claim:

1. A trading card holder and display means comprising:

a) a three dimensional silhouette member having a front surface, a back surface and outlining walls around said silhouette member, b) means on said front surface of said silhouette member for supporting a trading card, c) means forming a part of said outlining walls of said silhouette member for mounting said silhouette member on a vertical surface, d) and means forming a part of said outlining walls of said silhouette member for mounting said silhouette member on a horizontal surface.

2. The trading card holder and display means of claim 1 wherein said silhouette member bears a likeness to an individual in said trading card's field of participation.

3. The trading card holder and display means of claim 1 wherein said silhouette member front surface constitutes a backstop for said means for supporting a trading card and said means for supporting comprises three narrow guide strips fixed to said front surface and positioned to form said display means.

4. The trading card holder and display means of claim 1 wherein said means for mounting said silhouette member comprises said outlining walls surrounding said silhouette member to suspend said trading card holder and display means on a suitable projection from said vertical wall.

5. A trading card holder and display means comprising:

a) a base container including (i) a platform (ii) a box formed on said platform with said box having an open top and a bottom closed by said platform, (iii) means defining a mounting means fixed to said platform in alignment with said box, b) a three dimensional silhouette member including (i) a front surface, and means defining a display opening mounted to said front surface, (ii) outlining walls extending from said front surface, (iii) a cutout opening formed in one of said outlining walls, said cutout opening being in alignment with said display opening, c) said mounting means fixed to said platform and said cutout opening formed in said outlining wall being adapted to cooperate with each other for removably attaching said silhouette member to said base container with said display opening adapted to display trading cards or the like at the front of said front surface and said box adapted to store trading cards or the like behind said front surface.

6. The trading card holder and display means of claim 5 wherein said outlining wall of said silhouette member having said cutout opening is situated on the bottom of said silhouette member and said silhouette member rests on said platform of said base container.

7. The trading card holder and display means of claim 5 wherein said bottom outlining wall of said silhouette member includes said cutout opening, said mounting means fixed to said platform includes a dog block with a circumventing bead, and said cutout opening in said bottom outlining wall is adapted to cooperate with said dog block and circumventing bead to removably attach said silhouette member to said platform when said outlining wall comes to rest on said platform.

8. The trading card holder and display means of claim 5 wherein said base container includes a storage box comprising four walls, front, back and two side walls of said box, and a bottom for said storage box including a bottom extension extending beyond said front wall of said storage box, and mounting means including means formed on said bottom extension comprising a dog block for mounting said trading card holder and display means to said base container.

9. The trading card holder and display means of claim 8 with the addition of a fence member attached to said bottom extension of said storage box, said fence member being spaced from said dog block on said bottom extension by a distance adequate to permit said cutout opening in said outlining wall to cooperate with said dog block and to place said front surface of said silhouette member against said fence member.

* * * * *